US012624551B2

(12) United States Patent
Rudyan

(10) Patent No.: US 12,624,551 B2
(45) Date of Patent: May 12, 2026

(54) EDGE FLASHING APPARATUS, AND A METHOD OF USING SAME

(71) Applicant: Amir Rudyan, Canoga Park, CA (US)

(72) Inventor: Amir Rudyan, Agoura Hills, CA (US)

( * ) Notice: Subject to any disclaimer, the term of this patent is extended or adjusted under 35 U.S.C. 154(b) by 197 days.

(21) Appl. No.: 18/587,928

(22) Filed: Feb. 26, 2024

(65) Prior Publication Data

US 2025/0270815 A1 Aug. 28, 2025

(51) Int. Cl.
*E04D 13/15* (2006.01)
*E04D 13/04* (2006.01)

(52) U.S. Cl.
CPC ..... *E04D 13/15* (2013.01); *E04D 13/0459* (2013.01); *E04D 2013/0468* (2013.01)

(58) Field of Classification Search
CPC ..... E04D 13/15; E04D 13/0459; E04D 2013/0468; E04D 13/158; E04B 1/003
See application file for complete search history.

(56) References Cited

U.S. PATENT DOCUMENTS 2,922,385 A * 1/1960 Murray ..... E04D 13/158 52/97
3,086,324 A * 4/1963 Cheney ..... E04D 13/15 52/96
3,137,970 A * 6/1964 Tiernan ..... E04D 13/15 52/630
3,242,622 A * 3/1966 Snead ..... E04D 13/15 52/364
3,243,926 A * 4/1966 Keyt ..... E04D 13/15 52/287.1
3,668,811 A * 6/1972 Pollard ..... E04D 13/15 52/60
4,598,507 A * 7/1986 Hickman ..... E04D 13/155 52/96
4,848,045 A * 7/1989 Nichols ..... B29C 66/8221 52/60
4,969,250 A * 11/1990 Hickman ..... E04D 13/15 228/173.6
5,251,411 A * 10/1993 Kelley ..... E04D 13/15 52/60
5,388,379 A * 2/1995 Lamberti ..... E04D 13/15 52/468
5,394,666 A * 3/1995 Zahner, III ..... E04D 3/366 52/302.1

(Continued)

*Primary Examiner* — Rodney Mintz
(74) *Attorney, Agent, or Firm* — Aziz M. Ahsan; AHSAN & ASSOCIATES, PLLC

(57) ABSTRACT

The present invention relates generally to an edge flashing apparatus, and a method of using same. The invention encompasses an edge flashing that is installed at an edge of a structure, such as, for example, a wooden deck, a roof, a building, etc. The edge flashing has a first or upper edge that is secured to the structure, while the second or lower edge is over and below the edge of the structure. For some applications, the second edge could also have a drip edge to allow the water or moisture to be directed in a certain direction. The edge flashing apparatus may have a coating of at least one layer of deck material or concrete, and at least one layer of at least one covering material or deck coating or waterproofing membrane or waterproofing system. The invention also provides a method of using the inventive edge flashing apparatus.

20 Claims, 2 Drawing Sheets

(56) References Cited

U.S. PATENT DOCUMENTS 5,414,965 A * 5/1995 Kelley ..... E04D 13/064 52/60
5,586,414 A * 12/1996 Tawzer ..... E04D 5/14 52/96
5,619,827 A * 4/1997 Church ..... E04D 13/155 52/60
5,893,247 A * 4/1999 Hickman ..... E04D 3/405 52/60
6,578,322 B2 * 6/2003 Kintop ..... E04D 13/155 52/60
6,912,813 B2 * 7/2005 Grizenko ..... E04D 13/1478 52/95
7,735,267 B1 * 6/2010 Ayers, Jr. ..... E04D 13/15 52/60
7,941,989 B2 * 5/2011 Morsching ..... E04B 5/00 52/92.1
7,954,279 B2 * 6/2011 Covone ..... E04D 13/15 52/716.2
8,024,894 B1 * 9/2011 Ayers, Jr. ..... E04D 13/155 52/60
8,281,521 B1 * 10/2012 Rasmussen ..... E04D 13/158 52/60
8,407,960 B2 * 4/2013 Morsching ..... E04B 1/003 52/489.1
8,782,960 B2 * 7/2014 Nark ..... E04D 13/103 52/13
8,869,466 B2 * 10/2014 Garcia ..... E04F 19/00 52/60
9,163,408 B2 * 10/2015 West ..... E04D 13/1681
9,284,734 B1 * 3/2016 Inzeo ..... E04B 1/665
10,060,134 B2 * 8/2018 Stiglmayr ..... E04D 13/15
10,077,558 B2 * 9/2018 Heo ..... E04D 1/3405
10,132,085 B2 * 11/2018 Bredeweg ..... E04D 13/0459
10,214,910 B1 * 2/2019 Inzeo ..... E04D 13/155
10,316,521 B1 * 6/2019 Van Dam ..... E04D 13/1643
10,844,604 B2 * 11/2020 Folkersen ..... E04D 13/158
10,889,991 B2 * 1/2021 Folkersen ..... E04D 13/1585
10,968,635 B1 * 4/2021 Duran ..... E04D 3/363
11,266,142 B1 * 3/2022 Bishop ..... E04D 13/004
12,104,382 B1 * 10/2024 Brown ..... E04D 13/0459
2002/0178671 A1 * 12/2002 Gembala ..... E04D 13/0459 52/302.6
2003/0061771 A1 * 4/2003 Kintop ..... E04D 13/155 52/58
2003/0121217 A1 * 7/2003 Grizenko ..... E04D 13/158 52/287.1
2003/0159379 A1 * 8/2003 Pickler ..... E04D 13/0459 52/283
2007/0074466 A1 * 4/2007 Rasmussen ..... E04D 13/15 52/97
2008/0005975 A1 * 1/2008 Thompson ..... E04B 1/003 52/62
2009/0056235 A1 * 3/2009 Morsching ..... E04B 1/64 52/741.1
2010/0287849 A1 * 11/2010 Covone ..... E04D 13/15 52/741.3
2011/0209434 A1 * 9/2011 Nark ..... E04D 13/106 52/745.21
2011/0277392 A1 * 11/2011 Morsching ..... E04B 1/003 52/58
2012/0233933 A1 * 9/2012 Rasmussen ..... B21D 5/08 52/58
2013/0055651 A1 * 3/2013 Garcia ..... E04F 19/00 52/741.3
2013/0180183 A1 * 7/2013 Morsching ..... E04B 1/003 52/58
2014/0130447 A1 * 5/2014 West ..... E04D 13/1681 428/192
2014/0290152 A1 * 10/2014 Morsching ..... E04D 13/15 52/302.1
2016/0002934 A1 * 1/2016 Morsching ..... E04F 19/064 52/741.1
2018/0066436 A1 * 3/2018 Stiglmayr ..... E04D 13/0459
2018/0209152 A1 * 7/2018 Heo ..... E04D 13/0459
2018/0209153 A1 * 7/2018 Heo ..... E04D 13/1585
2018/0223537 A1 * 8/2018 Bredeweg ..... E04D 13/0459
2018/0347197 A1 * 12/2018 Folkersen ..... E04D 13/158
2018/0347199 A1 * 12/2018 Folkersen ..... E04D 13/0459
2022/0205247 A1 * 6/2022 Zielinski ..... E04D 12/002
2022/0412093 A1 * 12/2022 Bordin ..... E04F 17/00
2024/0026675 A1 * 1/2024 Weber ..... E04B 5/14
2024/0301698 A1 * 9/2024 Brown ..... E04D 13/0459
2024/0417977 A1 * 12/2024 Brown ..... E04D 13/0459

* cited by examiner

EDGE FLASHING APPARATUS, AND A METHOD OF USING SAME

FIELD OF THE INVENTION

The present invention relates generally to an edge flashing apparatus, and a method of using same. The invention encompasses an edge flashing that is installed at an edge of a structure, such as, for example, a wooden deck, a roof, a building, etc. The edge flashing has a first or upper edge that is secured to the structure, while the second or lower edge is over and below the edge of the structure. For some applications, the second edge could also have a drip edge to allow the water or moisture to be directed in a certain direction. The edge flashing apparatus may have a coating of at least one layer of deck material or concrete, and at least one layer of at least one covering material or deck coating or waterproofing membrane or waterproofing system. The invention also provides a method of using the inventive edge flashing apparatus.

BACKGROUND INFORMATION

The edge metals used with deck coatings or roofing systems are flashings which are installed at the open ends of exposed decks, such as, for example, a roof or a balcony, to properly seal the deck's edges from water penetrating into the structure or assembly.

Traditionally, there are two types of edge metals on decks when doing a deck coating application, one is called an edge metal flashing, and the second is called gravel stop flashing.

The edge metal flashing has a flat section that lays flat on the deck, and then the flashing is bent either straight down or have some sort of return, but eventually the flashing is bent downwards. At the end of the edge metal flashing there is a small bend facing outwards from the deck which is known as a drip edge.

The second type of flashing is called a gravel stop flashing which is similar to the edge metal flashing, except that it has a sharp bump at the edge to accommodate the thickness of the roofing material or membrane.

This invention improves on the deficiencies of the prior art and provides an inventive deck edge flashing apparatus, and a method of using same.

PURPOSES AND SUMMARY OF THE INVENTION

The invention is a novel edge flashing apparatus, and a method of using same.

Therefore, one purpose of this invention is to provide an edge flashing apparatus, and a method of using same.

Another purpose of this invention is to provide an edge flashing apparatus having a flashing flat bump that is higher than a flashing deck edge.

Yet another purpose of this invention is to provide an edge flashing apparatus where at least one layer of a metal mesh covers a portion of the edge flashing.

Still yet another purpose of this invention is to provide an edge flashing apparatus where at least one layer of concrete covers a portion of the flashing.

Yet another purpose of this invention is to provide an edge flashing apparatus where at least one layer of at least one covering material covers a portion of the flashing.

Therefore, in one aspect this invention comprises an edge flashing apparatus, comprising:

(a) an edge section having a substantially flat surface, and having a first edge end, and a second edge end;
(b) a sloped section having a substantially flat sloped surface, and having a first sloped end, and a second sloped end, and wherein said first sloped end is connected to said second edge end;
(c) a bump section having a substantially flat surface, and having a first bump end, and a second bump end, and wherein said first bump end is connected to said second sloped end;
(d) a straight edge section having a substantially flat surface, and having a first straight edge end, and a second straight edge end, and wherein said first straight edge end is connected to said second bump end; and
(e) wherein said bump section is at a height above said edge section, to form said edge flashing apparatus.

In another aspect this invention comprises an edge flashing apparatus, comprising:

(a) an edge section having a substantially flat surface, and having a first edge end, and a second edge end;
(b) a sloped section having a substantially flat sloped surface, and having a first sloped end, and a second sloped end, and wherein said first sloped end is connected to said second edge;
(c) a sloped bump section having a substantially flat surface, and having a first sloped bump end, and a second sloped bump end, and wherein said first sloped bump end is connected to said second edge;
(d) a straight edge section having a substantially flat surface, and having a first straight edge end, and a second straight edge end, and wherein said first straight edge end is connection to said second sloped bump edge; and
(e) wherein said sloped bump section is at a height above said edge section, to form said edge flashing apparatus.

DETAILED DESCRIPTION

Figure 1:
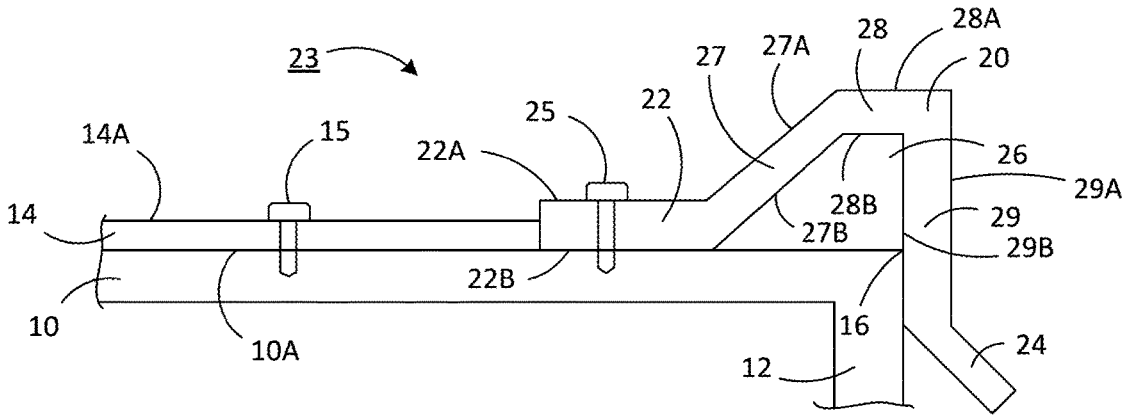
FIG. 1, illustrates a side view of an inventive edge flashing apparatus, according to a first embodiment of the invention.

The inventive edge flashing apparatus, and a method of using same will now be discussed with reference to FIGS. 1 through 6. Although the scope of the present invention is much broader than any particular embodiment, a detailed description of the preferred embodiment follows together with drawings. These drawings are for illustration purposes only and are not drawn to scale. Like numbers represent like features and components in the drawings.

FIG. 1, illustrates a side view of an inventive edge flashing apparatus 23, according to a first embodiment of the invention. A flashing 20, has a first or upper end or edge or flashing edge section 22, a flashing slope section 27, a flashing bump section 28, a second or lower end or edge or flashing straight edge section 29, all of which are connected to each other as shown in FIG. 1. The first or upper end or edge or flashing edge section 22, has an upper or outer surface 22A, a lower or inner surface 22B. The flashing slope section 27, has an upper or outer surface 27A, a lower or inner surface 27B. The flashing bump section 28, has an upper or outer surface 28A, a lower or inner surface 28B. The second or lower end or edge or flashing straight edge section 29, has an upper or outer surface 29A, a lower or inner surface 29B. The first or upper end or edge section 22, of the flashing 20, is placed on a deck 10, having a top or upper deck surface 10A, which is connected to a deck edge or extension or wall 12, creating a deck corner 16, and then the first or edge section 22, is secured to the top surface 10A, of the deck 10, via at least one securing means 25, such as, for example, a nail 25, a deck nail 25, a staple 25, a flashing nail 25, a screw 25, and combinations thereof, to name a few. The second or lower end or flashing straight edge section 29, is placed along the deck edge 12. For some applications the flashing 20, could also have a drip edge 24, along the second or lower edge or flashing straight edge section 29, so as to channel moisture or water (not shown). At least one mesh 14, such as, for example, a metal mesh 14, a plastic mesh 14, a composite material mesh 14, and combinations thereof, to name a few, having an upper or top or outer surface 14A, is secured to the top surface 10A, of the deck 10, using at least one securing means 15, such as, for example, nail 15, mesh nail 15, staple 15, screw 15, and combinations thereof, to name a few. For some applications, the flashing straight edge section 29, is below the deck corner 16, and is against or adjacent the deck edge 12. It should be appreciated that the flashing slope section 27, the flashing flat bump section 28, and the flashing straight edge section 29, creates an area 26, which is generally hollow, and which allows for the air movement above and around the deck 10, corner 16, and deck edge 12. Deck 10, as used herein can be a regular wooden deck 10, or a roof deck 64, or a building deck 64.

Figure 2:
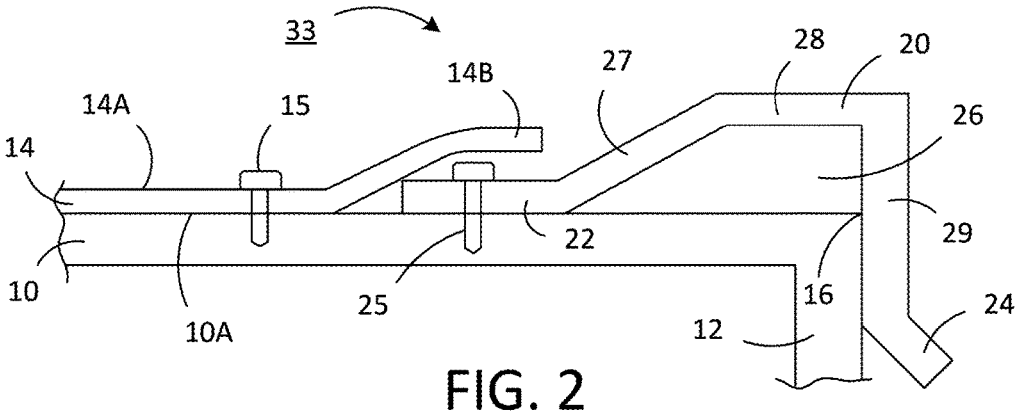
FIGS. 2, illustrates a side view of an inventive edge flashing apparatus, according to a second embodiment of the invention.

FIGS. 2, illustrates a side view of an inventive edge flashing apparatus 33, according to a second embodiment of the invention. The inventive deck edge flashing apparatus 33, is similar to the inventive deck edge flashing apparatus 23, however, the mesh 14, has an upper or outer surface 14A, and a mesh extension 14B, which extends over at least a portion of the first or edge section 22, of the flashing 20. For some applications, the mesh extension 14B, could also cover or be over at least a portion of the securing means 25. For some applications, the mesh extension 14B, could also cover or be over at least a portion of the flashing slope section 27, as more clearly shown in FIG. 3.

Figure 3:
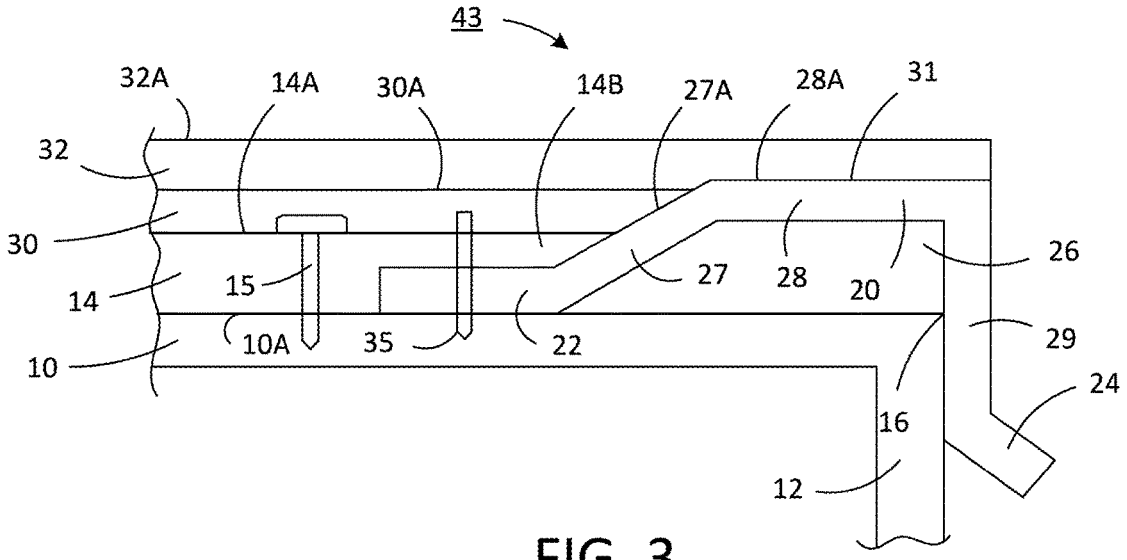
FIG. 3, illustrates a side view of an inventive edge flashing apparatus, according to a third embodiment of the invention.

FIG. 3, illustrates a side view of an inventive edge flashing apparatus 43, according to a third embodiment of the invention. The inventive deck edge flashing apparatus 43, is similar to the inventive deck edge flashing apparatus 33, but now has at least one coating or layer of at least one deck material 30, or roofing material 30, on top of surface 14A, of the mesh 14. The at least one concrete layer 30, has an outer or upper surface 30A. It is preferred that an edge of the concrete layer 30, terminates along the surface of the flashing slope section 27. For some applications it is preferred that an edge of the concrete layer 30, terminates along the surface of the flashing slope section 27, and adjacent the surface of the flashing flat bump section 28. At least one coating or layer of at least one covering material 32, having an outer or upper surface 32A, is applied over the upper surface 30A, of the at least one concrete layer 30. It is preferred that the edge of the at least one covering material 32, such as, for example, a deck coating 32, terminates along the upper surface 28A, of the flashing flat bump section 28. For some applications, it is preferred that the edge of the at least one deck coating 32, terminates along the upper surface 28A, of the flashing flat bump section 28, and the edge of the flashing straight edge section 29. For some applications the top deck coating layer 32, can be used to provide a sealer 32, or a sealing layer 32, for the at least one concrete layer 30. The at least one top deck coating layer 32, could also be made from a material that has a textured upper surface 32A, which would allow a person (not shown) to walk over it, and which could provide slip resistance or a non-slippery surface 32A, to the at least one deck coating layer 32. It should be appreciated that the upper surface 27A, of the slope section 27, provides a large or big area to hold or contain the roofing or deck material 30. For most applications it is preferred that the upper surface 30A, of the roofing or deck material 30, remains flush with or above the upper surface 28A, of the bump section 28. Additionally, it should be appreciated that the upper surface 28A, of the bump section 28, provides a large or bigger or extended surface 28A, for the at least one deck coating layer 32, to securely bond or adhere to and to create a bond or seal 31, between the at least one deck coating layer 32, and the upper surface 28A, of the bump section 28. This bond or seal 31, also prevents any moisture or water from reaching the at least one roofing or deck material 30. For some applications at least one securing means 35, could be used to secure the at least one mesh extension 14B, to the edge section 22, and the deck 10.

Figure 4:
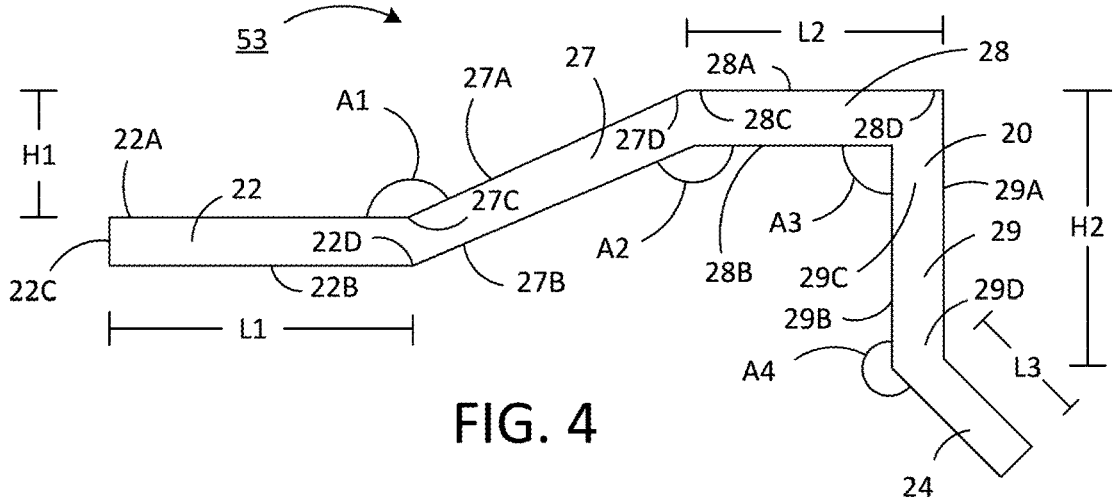
FIG. 4, illustrates a side view of an inventive edge flashing apparatus, according to a fourth embodiment of the invention.

FIG. 4, illustrates a side view of an inventive edge flashing apparatus 53, according to a fourth embodiment of the invention. The inventive edge flashing apparatus 53, comprises of the flashing 20, having a first or upper end or edge or flashing edge section 22, a flashing slope section 27, a flashing flat bump section 28, a second or lower end or edge or flashing straight edge section 29, all of which are connected each to the other. The first or upper end or edge or flashing edge section 22, has the upper or outer surface 22A, the lower or inner surface 22B, a first end 22C, and a second end 22D. The flashing slope section 27, has the upper or outer surface 27A, the lower or inner surface 27B, a first end 27C, and a second end 27D. The flashing bump section 28, has the upper or outer surface 28A, the lower or inner surface 28B, a first end 28C, and a second end 28D. The second or lower end or edge or flashing straight edge section 29, has the upper or outer surface 29A, the lower or inner surface 29B, a first end 29C, and a second end 29D. The second end 22D, of the edge section 22, is connected to the first end 27C, of the slope section 27. The first end 28C, of the bump section 28, is connected to the second end 27D, of the slope section 27. The first end 29C, of the straight edge section 29, is connected to the second end 28D, of the bump section 28. The flashing edge section 22, and the flashing slope section 27, has an upper angle A1, and the flashing slope section 27, and the flashing flat bump section 28, has a lower angle A2, and the flashing flat bump section 28, and the flashing straight edge section 29, has a lower angle A3, and the flashing straight edge section 29, and the drip edge 24, has a lower angle A4. For some applications it is preferred that the upper angle A1, is between about 45 degrees to about 170 degrees, and the lower angle A2, is between about 45 degrees, and about 170 degrees, and the lower angle A3, is between about 45 degrees to about 135 degrees, and the lower angle A4, is between about 110 degrees to about 180 degrees. For some applications the flashing 20, having the first or upper end or edge or flashing edge section 22, has a length L1, of between about one half inches (12.7 mm) to about 10 inches (254 mm), and where the flashing slope section 27, has a height H1, of between about one eight of an inch (3.2 mm) to about 4 inches (102 mm), and where the flashing flat bump section 28, or a second flashing slope section 58, has a length L2, of between about one eighth of an inch (3.2 mm) to about 10 inches (254 mm), and where the second or lower end or edge or flashing straight edge section 29, has a length or height H2, of between about one inch (25.4 mm) to about 8 inches (203 mm). Additionally, for some applications the drip edge 24, could have a length L3, of between about one eight inch (3.2 mm) to about one inch (25.4 mm).

Figure 5:
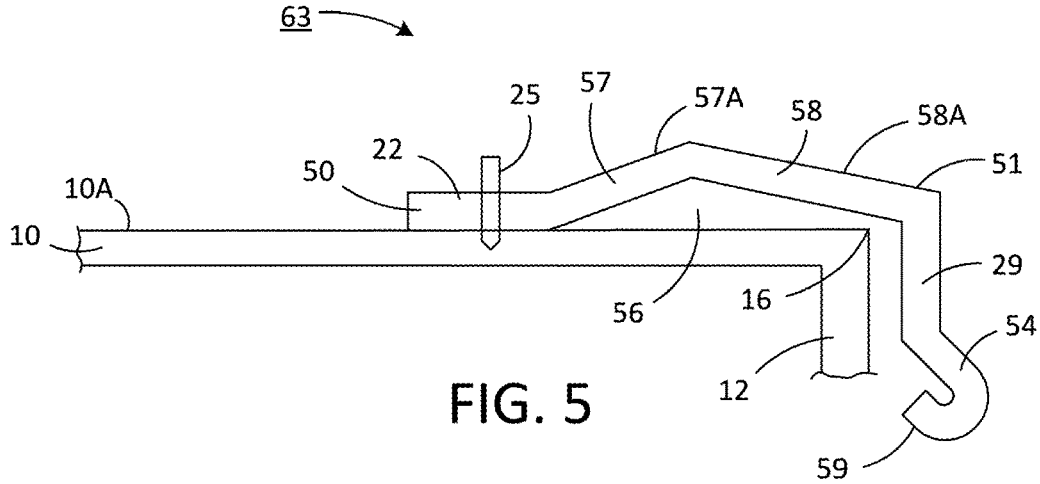
FIG. 5, illustrates a side view of an inventive edge flashing apparatus, according to a fifth embodiment of the invention.

FIG. 5, illustrates a side view of an inventive edge flashing apparatus 63, according to a fifth embodiment of the invention. The inventive deck edge flashing apparatus 63, is similar to the inventive deck edge flashing apparatus 23, however the shape of the flashing 50, is different than the flashing 20. The flashing 50, has the first or upper end or edge or flashing edge section 22, a first flashing slope section 57, a second flashing slope section 58, a second or lower end or edge or flashing straight edge section 29, all of which are connected to each other as shown in FIG. 5. For some applications the flashing 50, could also have a drip edge 54, along the second or lower edge section 29, so as to channel moisture or water (not shown). For some applications the drip edge 54, could also have a drip edge return 59, which would create a "U" turn for the drip edge 54. It should be appreciated that the first flashing slope section 27, the second flashing slope section 58, and the flashing straight edge section 29, creates an area 56, which is generally hollow, and which allows for the air movement above and around the corner 16, of the deck 10, and the deck edge 12. It should be appreciated that an upper surface 57A, of the first flashing slope section 57, provides a large or big area to hold or contain the roofing or deck material 30. For most applications it is preferred that the upper surface 30A, of the roofing or deck material 30, remains flush with or above an upper surface 58A, of the second flashing slope section 58. Additionally, it should be appreciated that the upper surface 58A, of the second flashing slope section 58, provides a large or bigger or extended surface 58A, for the at least one deck coating layer 32, to securely bond or adhere to and to create a bond or seal 51, between the at least one deck coating layer 32, and the upper surface 58A, of the second flashing slope section 58. This bond or seal 51, also prevents any moisture or water from reaching the at least one roofing or deck material 30.

Figure 6:
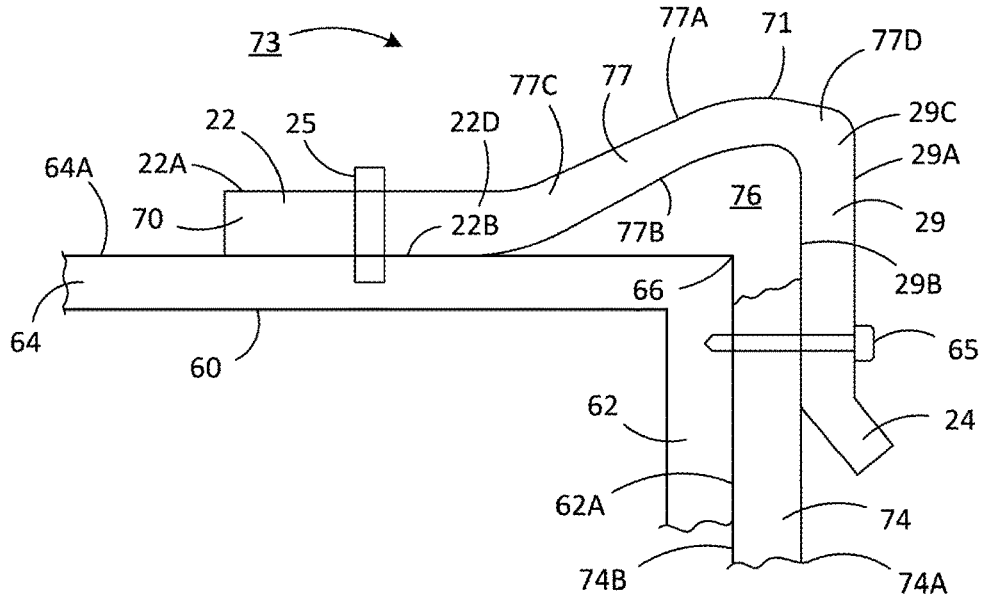
FIG. 6, illustrates a side view of an inventive edge flashing apparatus according to a sixth embodiment of the invention.

FIG. 6, illustrates a side view of an inventive edge flashing apparatus 73, according to a sixth embodiment of the invention. The inventive edge flashing apparatus 73, is similar to the inventive edge flashing apparatus 23, 63, however, the inventive edge flashing apparatus 73, has at least one flashing 70, and the flashing is secured to a different structure 60. The flashing 70, is similar to the flashing 20, 50, except that the flashing 70, has a raised and rounded or curved section 77, which connects the edge section 22, to the straight edge section 29. As one can appreciate that the raised and curved section 77, combines the slope section 27, and the bump section 28, into one section 77. Similarly, the raised and curved section 77, combines the first slope section 57, and the second slope section 58, into one section 77. The raised and curved section 77, has an upper or outer surface 77A, a lower or inner surface 77B, a first end 77C, and a second end 77D, and where the first end 77C, is in contact with the second end 22D, of the edge section 22, and the second end 77D, is in contact with the first end 29C, of the straight edge section 29. It should be appreciated that sections 27, 57, 77, can also act as a gravel stop 27, 57, 77, or concrete stop 27, 57, 77. Once at least one layer of concrete 30, has been placed on top of the mesh 14, one would then cover the upper surface 30A, with at least one coating of at least on deck coating layer 32. The different structure 60, could be, for example, a house 60, a warehouse 60, a building 60, to name a few, having a first or roof surface 64, a second or subsurface structure or exterior wall 62, and when joined would create a corner 66. The roof 64, has a roof exposed surface 64A, and the subsurface structure 62, has an exposed subsurface 62A. At least one exterior structure 74, having an exterior or outer surface 74A, and an interior or inner surface 74B, such that the inner surface 74B, is in contact with or adjacent to the exposed subsurface 62A. For some applications the at least one exterior structure 74, could be selected from a group comprising stucco, siding, brick, wood, composite material, panel, plastic panel, and combination thereof, to name a few. For most applications it is preferred that the outer surface 74A, has a finished surface 74A. The edge section 22, of the flashing 20, 50, 70, is placed on top of the roof surface 64, such that the inner surface 22B, is in contact with or adjacent to the first exposed surface 64A. Additionally, the inner surface 29B, of the straight edge section 29, of the flashing 20, 50, 70, is in contact with or adjacent the outer surface 74A, of the at least one exterior structure 74. As one can appreciate that the placing of the flashing 20, 50, 70, over the corner 66, prevents any outside water or rain from entering the areas between the at least one exterior structure 74, and the exterior wall 62. Additionally, as one can appreciate that the edge of the flashing 20, 50, 70, extends beyond the corner 66, or over the exterior wall 62, or over the exterior wall surface 74A, of the at least one exterior structure 74, to create a complete seal at the roof or wall's edge 66, along with at the end of the at least one exterior structure 74, which is near or adjacent the corner 66. For some applications one could also use at least one securing means 65, where the securing means 65, could be used to secure the straight edge section 29, to the at least one exterior structure 74. Similarly, for some applications one could also use at least one securing means 65, where the securing means 65, could be used to secure the straight edge section 29, to the at least one exterior structure 74, and the exterior wall 62, or the subsurface structure 62. It should be appreciated that the upper surface 77A, of the raised and curved section 77, provides a large or big area to hold or contain the roofing or deck material 30. However, care should be taken that the roofing or deck material 30, does not take all of the upper surface 77A, of the raised and curved section 77, as the upper surface 77A, also needs to be shared with the at least one deck coating 32, to create a bond or seal 71, with a portion of the upper surface 77A, of the raised and curved section 77. Furthermore, as one can appreciate that the upper surface 77A, of the raised and curved section 77, provides a large or bigger or extended surface 77A, for the at least one deck coating layer 32, to securely bond or adhere to and to create a bond or seal 71, between the at least one deck coating layer 32, and the upper surface 77A, of the raised and curved section 77. This bond or seal 71, also prevents any moisture or water from reaching the at least one roofing or deck material 30.

For some applications, the flashing straight edge section 29, could start above or below the deck corner 16, and it could be against or adjacent the deck edge 12, as more clearly seen in FIG. 1, or it could be a little distance away from the deck edge 12, as more clearly seen in FIG. 5.

The material for the deck 10, could be selected from a group comprising an ABS (Acrylonitrile Butadiene Styrene) material, a plastic material, a polymeric material, a PTFE (polytetrafluoroethylene) material, a metallic material, a wood material, a plywood material, a composite material, a concrete material, and combinations thereof, to name a few.

The at least one deck material 30, or roofing material 30, could be selected from a group comprising a concrete material 30, a filler material 30, a mud-bed material 30, a sand mixed with a binder material 30, and combinations thereof, to name a few.

The at least one coating or layer of at least one covering material 32, could be selected from a group comprising a deck coating 32, a waterproofing membrane 32, a waterproofing system 32, and combinations thereof, to name a few.

The thickness of the flashing 20, 50, 70, can have a thickness between about 28 gauge to about 14 gauge, or between about 0.012 inches (0.30 mm) to about 1 inch (25.4 mm).

The material for the flashing 20, 50, 70, or the edge metal 20, 50, 70, can be selected from a group comprising galvanized metal, bonderized metal, copper, stainless steel, plastic, and combinations thereof, to name a few. A bonderized metal is a galvanized steel sheet plated in zinc phosphate for building facades and roofing.

The at least one deck material 30, or roofing material 30, could have a layer 30, having a thickness from between about one-eighth inch (3.2 mm) to about 12 inches (305 mm).

The at least one covering material 32, or deck coating layer 32, could have a thickness from between about 10 Mils (0.25 mm) to about 12 inches (305 mm).

The at least one securing means 15, 25, 35, 65, could be selected from a group comprising a nail, a deck nail, a staple, a screw, and combinations thereof, to name a few.

The inventive flashing 20, 50, 70, could be sold under a trademark, such as, Crete Edge or Crete-Edge 20, 50, 70.

It should be appreciated that when gravel stop edge metals are used, the concrete layer is poured all the way to the gravel stop leaving no exposed horizontal metal to attach the membrane to. Thus, the seal of the edge of the deck using gravel stop edge metals is very weak and of course prone to failures. Furthermore, when a membrane separates from the edge of the metal's edge, it creates an opening for water, such as, for example, rainwater, to get in and further damage the edge seal. Additionally, with edge metal flashings, there is no easy way to terminate the concrete layer, which needs to be approximately a minimum of one quarter inch (6.4 mm) thick. This requires an extra step of installing some sort of patch material to transition from the one quarter inch (6.4 mm) high edge of the concrete layer down to the surface of the edge metal flashing, adding costs and installation times. As one can see that the inventive flashing 20, 50, 70, solves this problem by creating an edge metal that on the one hand has a gravel stop 27, 57, 77, to terminate the concrete 30, against without having to apply the extra layer of patch material to transition down to the edge metal's surface while at the same time, leaves a large enough horizontal surface 28, (see "L2" in FIG. 4), also known as "a flange" to which the coatings/membranes 32, can easily be attached to and create a long lasting seal at the edge of the deck 10, 64.

Thus, the present invention is not limited to the embodiments described herein and the constituent elements of the invention can be modified in various manners without departing from the spirit and scope of the invention. Various aspects of the invention can also be extracted from any appropriate combination of a plurality of constituent elements disclosed in the embodiments. Some constituent elements may be deleted in all of the constituent elements disclosed in the embodiments. The constituent elements described in different embodiments may be combined arbitrarily.

Still further, while certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions.

It should be further understood that throughout the specification and claims several terms have been used and they take the meanings explicitly associated herein, unless the context clearly dictates otherwise. For example, the phrase "in one embodiment" as used herein does not necessarily refer to the same embodiment, though it may. Additionally, the phrase "in another embodiment" as used herein does not necessarily refer to a different embodiment, although it may. Thus, various embodiments of the invention may be readily combined, without departing from the scope or spirit of the invention.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. An edge flashing apparatus, comprising:

(a) a first edge section having a substantially flat surface, and having a first edge end, and a second edge end;

(b) a sloped section having a substantially flat sloped surface, and having a first sloped end, and a second sloped end, and wherein said first sloped end is connected to said second edge end;

(c) a bump section having a substantially flat surface, and having a first bump end, and a second bump end, and wherein said first bump end is connected to said second sloped end;

(d) a straight edge section having a substantially flat surface, and having a first straight edge end, and a second straight edge end, and wherein said first straight edge end is connected to and extends below said second bump end;

(e) a drip edge having a first drip edge end, and a second drip edge end, and wherein said first drip edge end is connected to said second straight edge end;

(f) wherein said bump section is located at a height above said first edge section and said straight edge section, to form said edge flashing apparatus; and (g) wherein said first edge section is configured to be secured to a substantially flat horizontal surface of a deck structure.

2. The edge flashing apparatus of claim 1, further comprising said deck structure, and wherein said deck structure has said substantially flat horizontal surface and a substantially flat vertical surface, and wherein said first edge section is secured to said substantially flat horizontal surface of said deck structure using at least one securing means, wherein said deck structure is selected from a group consisting of a deck, a roof, a building, and combinations thereof.

3. The edge flashing apparatus of claim 1, further comprising said deck structure, and wherein said deck structure has said substantially flat horizontal surface and a substantially flat vertical surface, and wherein said first edge section is secured to said substantially flat horizontal surface of said deck structure using at least one securing means, wherein said at least one securing means is selected from a group consisting of a nail, a deck nail, a staple, a flashing nail, a screw, and combinations thereof.

4. The edge flashing apparatus of claim 1, further comprising said deck structure, and wherein said deck structure has said substantially flat horizontal surface and a substantially flat vertical surface, and wherein said first edge section is secured to said substantially flat horizontal surface of said deck structure using at least one securing means, wherein at least one mesh structure is adjacent said first edge section.

5. The edge flashing apparatus of claim 1, further comprising said deck structure, and wherein said deck structure has said substantially flat horizontal surface and a substantially flat vertical surface, and wherein said first edge section is secured to said substantially flat horizontal surface of said deck structure using at least one securing means, wherein at least one mesh structure is adjacent said first edge section, and wherein said at least one mesh structure is secured to said substantially flat horizontal surface of said deck structure.

6. The edge flashing apparatus of claim 1, further comprising said deck structure, and wherein said deck structure has said substantially flat horizontal surface and a substantially flat vertical surface, and wherein said first edge section is secured to said substantially flat horizontal surface of said deck structure using at least one securing means, wherein at least one mesh structure overlaps at least a portion of said first edge section.

7. The edge flashing apparatus of claim 1, further comprising said deck structure, and wherein said deck structure has said substantially flat horizontal surface and a substantially flat vertical surface, and wherein said first edge section is secured to said substantially flat horizontal surface of said deck structure using at least one securing means, wherein at least one mesh structure overlaps at least a portion of said first edge section, and wherein said at least one mesh structure is secured to said substantially flat horizontal surface of said deck structure.

8. The edge flashing apparatus of claim 1, having a return edge, wherein said return edge has a first return edge end, and a second return edge end, and wherein said first return edge end is secured to said second drip edge end.

9. The edge flashing apparatus of claim 1, further comprising said deck structure, and wherein said deck structure has said substantially flat horizontal surface and a substantially flat vertical surface, and wherein said first edge section is secured to said substantially flat horizontal surface of said deck structure using at least one securing means, wherein said straight edge section is adjacent said substantially flat vertical surface of said deck structure.

10. The edge flashing apparatus of claim 1, wherein said second edge end and said first slope end form a first angle, and wherein said first angle is between about 45 degrees to about 170 degrees, said second slope end and said first bump end form a second angle, and wherein said second angle is between about 45 degrees, and about 170 degrees, and wherein said second bump end and said first straight edge end forms a third angle, and wherein said third angle is between about 45 degrees to about 135 degrees.

11. The edge flashing apparatus of claim 1, wherein said first edge section has a first length, and wherein said first length is between about one half inches (12.7 mm) to about 10 inches (254 mm), and said slope section has a height, and wherein said height is between about one eight of an inch (3.2 mm) to about 4 inches (102 mm), and wherein said bump section has a second length, and wherein said second length is between about one eighth of an inch (3.2 mm) to about 10 inches (254 mm), and wherein said straight edge section has a third length, and wherein said third length is between about one inch (25.4 mm) to about 8 inches (203 mm).

12. The edge flashing apparatus of claim 1, wherein said edge flashing apparatus has a thickness of between about 0.012 inches (0.30 mm) to about 1 inch (25.4 mm).

13. The edge flashing apparatus of claim 1, wherein said edge flashing apparatus is formed from a material selected from a group consisting of a galvanized metal, a bonderized metal, copper, stainless steel, plastic, and combinations thereof.

14. The edge flashing apparatus of claim 1, further comprising:

(a) said deck structure, and wherein said deck structure has said substantially flat horizontal surface and a substantially flat vertical surface, and wherein said first edge section is secured to said substantially flat horizontal surface of said deck structure using at least one securing means, (b) at least one mesh structure having an upper mesh surface and a lower mesh surface, and wherein said lower mesh surface is in direct contact with said substantially flat horizontal surface of said deck structure, and said at least one securing means secures said at least one mesh structure to said substantially flat horizontal surface of said deck structure;

(c) at least one layer of at least one deck material has an upper deck material surface and a lower deck material surface, and wherein said lower deck material surface is in direct contact with said upper surface of said at least one mesh structure; and (d) at least one layer of at least one covering material covering at least a portion of said upper deck material surface of said at least one layer of deck material, and wherein said at least one covering material covers at least a portion of said bump section.

15. The edge flashing apparatus of claim 14, wherein said at least one layer of at least one deck material has a thickness between about one-eighth inch (3.2 mm) to about 12 inches (305 mm), and wherein said at least one layer of at least one covering material has a thickness from between about 10 Mils (0.25 mm) to about 12 inches (305 mm).

16. The edge flashing apparatus of claim 1, further comprising:

(a) said deck structure, and wherein said deck structure has said substantially flat horizontal surface and a substantially flat vertical surface, and wherein said first edge section is secured to said substantially flat horizontal surface of said deck structure using at least one securing means; and (b) at least one secondary wall structure having an inner wall surface, and an outer wall surface, and wherein said inner wall surface is adjacent said substantially flat vertical surface, and wherein said straight edge section is adjacent said outer wall surface of said at least one secondary wall structure.

17. The edge flashing apparatus of claim 16, wherein said at least one secondary wall structure is selected from a group consisting of stucco, siding, brick, wood, composite material, panel, plastic panel, and combination thereof.

18. An edge flashing apparatus, comprising:

(a) a first edge section having a substantially flat surface, and having a first edge end, and a second edge end;

(b) a first sloped section having a substantially flat sloped surface, and having a first sloped end, and a second sloped end, and wherein said first sloped end is connected to said second edge end;

(c) a sloped bump section having a substantially flat sloped surface, and having a first sloped bump end, and a second sloped bump end, and wherein said first sloped bump end is connected to said second sloped end of the first sloped section;

(d) a straight edge section having a substantially flat surface, and having a first straight edge end, and a second straight edge end, and wherein said first straight edge end is connected to and extends below said second sloped bump end;

(e) a drip edge having a first drip edge end, and a second drip edge end, and wherein said first drip edge end is connected to said second straight edge end;

(f) wherein said sloped bump section is located at a height above said first edge section and said straight edge section, to form said edge flashing apparatus;

(g) wherein said first edge section is configured to be secured to a substantially flat horizontal surface of a deck structure.

19. The edge flashing apparatus of claim 18, further comprising:

(a) said deck structure, and wherein said deck structure has said substantially flat horizontal surface and a substantially flat vertical surface, and wherein said first edge section is secured to said substantially flat horizontal surface of said deck structure using at least one securing means;

(b) at least one mesh structure having an upper mesh surface and a lower mesh surface, and wherein said lower mesh surface is in direct contact with said substantially flat horizontal surface of said deck structure, and said at least one securing means secures said at least one mesh structure to said substantially flat horizontal surface of said deck structure;

(c) at least one layer of at least one deck material has an upper deck material surface and a lower deck material surface, and wherein said lower deck material surface is in direct contact with said upper surface of said at least one mesh structure; and (d) at least one layer of at least one covering material covering at least a portion of said upper deck material surface of said at least one layer of deck material, and wherein said at least one covering material covers at least a portion of said bump section.

20. An edge flashing apparatus, comprising:

(a) a first edge section having a substantially flat surface, and having a first edge end, and a second edge end;

(b) a first sloped section having a substantially flat sloped surface, and having a first sloped end, and a second sloped end, and wherein said first sloped end is connected to said second edge end;

(c) a sloped bump section having a substantially flat sloped surface, and having a first sloped bump end, and a second sloped bump end, and wherein said first sloped bump end is connected to said second sloped end of the first sloped section;

(d) a straight edge section having a substantially flat surface, and having a first straight edge end, and a second straight edge end, and wherein said first straight edge end is connected to and extends below said second sloped bump end;

(e) a drip edge having a first drip edge end, and a second drip edge end, and wherein said first drip edge end is connected to said second straight edge end;

(f) a U-shaped return edge having a first return edge end, and a second return edge end, and wherein said first return edge end is connected to said second drip edge end;

(g) wherein said sloped bump section is located at a height above said first edge section and said straight edge section, to form said edge flashing apparatus; and (h) wherein said first edge section is configured to be secured to a substantially flat horizontal surface of a deck structure.

* * * * *